US005441309A

United States Patent [19]

D'Alessio et al.

[11] Patent Number: 5,441,309

[45] Date of Patent: Aug. 15, 1995

[54] NEGOTIABLE INSTRUMENT

[76] Inventors: Sergio D'Alessio; Ayna Alessio, both of 10315 Azuaga St., #60, San Diego, Calif. 92129

[21] Appl. No.: 48,802

[22] Filed: Apr. 19, 1993

[51] Int. Cl.[6] ..... B42D 15/00

[52] U.S. Cl. ..... 283/58; 283/57; 283/59

[58] Field of Search ..... 283/58, 57, 59, 70, 283/901; 235/468, 379, 489

[56] References Cited

U.S. PATENT DOCUMENTS

| | | | |
|---|---|---|---|
| 4,588,211 | 5/1986 | Greene | 283/70 |
| 4,614,362 | 9/1986 | Breen et al. | 283/58 X |
| 4,634,148 | 1/1987 | Greene | 283/70 |
| 4,681,348 | 7/1987 | Mowry, Jr. | 283/58 |
| 4,733,887 | 3/1988 | Mowry, Jr. | 283/58 |
| 4,749,213 | 6/1988 | Mowry, Jr. | 283/58 |
| 5,074,596 | 12/1991 | Castagnoli | 283/91 |
| 5,083,816 | 1/1992 | Folga et al. | 283/81 |

*Primary Examiner*—Willmon Fridie

*Attorney, Agent, or Firm*—Page Lohr

[57] ABSTRACT

A financial instrument that can be fully processed by automatic machinery is presented as the subject of this disclosure. Although many systems exist to facilitate processing of bank checks and the like, they arrive short of the advantages provided for in this invention. A combination of techniques in the art and new technologies taught herein provide a system that is useful to both human users, and machine processors. Since the invention is fully compatible with known processes, data from the document can be used in the old way, using old methods which include human input techniques. Alternatively, a fully automatic machine process is now possible and new processes for clearing checks can be adopted to increase the efficiency of processing. The new document also provides a mechanism that is more fraud and tamper resistant than is provided for in the art. The invention will contribute to safely expediting the transition of processing financial instruments manually to processing by modern computer automation processing techniques.

6 Claims, 4 Drawing Sheets

NEGOTIABLE INSTRUMENT

BACKGROUND OF THE INVENTION

An invention has been made that is related generally to negotiable instruments such as bank checks and is related specifically to the ways and means of recording and presenting information on negotiable instruments.

Financial instruments, negotiable documents, bank notes, including bank checks, counter checks, money orders and the like, present problems for their users. The institutional users who process the documents as well as the writers of the documents, suffer from limitations of currents designs. A first problem is the limited automation that is possible in the clearance house processing of the documents. A significant amount of manual input from human operators is required in the processing steps. A second problem is the possibility of use of the documents by fraudulent persons. A third problem is the difficulty involved in writing a document for people without sufficient writing skills.

To address the first problem, it is desirable to make the information on a check, machine readable. Several forms of data that is in a format usable by machines are well known. In fact, it has become commonplace in most industries to use the high speed and accuracy of computer automation to simplify business transactions. Many operations that were previously performed manually by a human operator, are now being accomplished automatically by machines. Generally, it is required for a change in the way that information is used to accompany new machine processes. For example, a common price tag with human usable numeric data is sometimes replaced by machine usable data in the form of an optical pattern. Today, even neighborhood grocery stores have product labels that have been coded with machine usable information that can be quickly and efficiently read by a machine at the checkout counter. A well known "bar code" pattern can be found, on products for sale at retail stores; on a company's assets that are subject to inventory control; and even on identification cards, such as student or library cards. A machine can access information coded into the bar pattern in an instant and proceed with desired transactions based on that information. A bar code pattern can not be read by a human operator, nor is it practical for a human to write a bar code pattern. The pattern is designed to be read and to be written by various machines.

In some applications, it is desirable for a human operator to be able to produce the data that can be later read by a machine. For example, a student taking an examination can code the answers onto a special answer sheet that can be read by a machine. By "blackening" bubble areas with letters that correspond to particular answers, an optical pattern is generated that can be machine read. The machine quickly identifies the questions answered correctly and questions answered incorrectly, thereby affecting accurate machine scoring. From a completed answer sheet, another person for example an instructor, could not readily decipher the coded answers. Once an answer sheet is prepared, it is meant to be read by a machine.

Sometimes it is desirable for humans to read-back the data that has been previously recorded. It is well known to use optical character recognition, OCR systems for these applications. Other systems are also possible. At the bottom of most bank checks is a line of numbers corresponding to account information. The numerals are written in a special font, for example Farrington 7B font, that can be read by either human users or by machine processors. Sometimes the machine reading means employs an optical scheme, but more commonly it is a magnetic means of identifying the digits of the numeral. With these systems, it is possible for a bank teller (human user) to read the account number printed on the bottom of a check during a personal visit of a customer, and it is also possible for a machine processor to read the number and gain access to the correct account information. To use characters that can be recognized by both human and machine, it is required that the characters of the special font be evenly spaced and for the line thicknesses that make up the character to be accurately positioned and controlled. Although it is possible for both human users and machine processors to read, it is prohibitively difficult for a human user to write the characters. The characters must be printed with high quality printing means and with special inks. Character recognition mechanisms are quite useful for data that is redundant from check-to-check; for example, the check writers account number. The number can be machine printed in the special font when the checks are printed by the institution issuing them. For data that is different from check-to-check, the font is not easily produced by the check writer. The check writer must enter the amount of the check: by hand. The resulting data is variable in its appearance, and the machines that recognize the fonts described above, cannot recognize the numerals that have been written by the check writer's hand.

There is a second major problem with the way that data is recorded on negotiable instruments. The information written by a check writer is susceptible to tampering by fraudulent persons.

If a document of the art is prepared for a certain amount by the proper writer of the check, it is possible that the data could be later altered to increase that amount. Sometimes a person can use a similar pen as the check writer and simply add to the writings made previously. Advanced techniques include a cut-and-paste method wherein even machine printed entries can be changed to increase the amount of the check. Of course, the practice is illegal and would result in a loss for either the bank or the writer of the check. Hand written data and information entities on common checks are subject to tampering.

It is a second possible source of fraud for banks to make changes in accounting procedures. A new procedure can be found to have accounting loopholes which allow users of the procedure to commit theft. Successful methods are those that have met the test of time and it is a tendency for-institutions to want to keep old methods. Because of the possibility of fraud, there is a string-reluctance for banks to convert to automation. For this reason, it is imperative that a new system take into account the old methods and that the new system is compatible with those old methods. Redundancy should be built into new methods so that old methods can be fully used as the new methods are learned and trust in those methods is gained.

A third problem with the documents of the known art is that in order to prepare them, a writer must have sufficient language skills to spell out the amount of the check in words. Foreigners and others without the ability to print words in the English language could not prepare a check properly with the old system. The system of the current invention does not require these written skills and is therefore simpler to use.

SUMMARY OF THE INVENTION

To remedy the deficiencies of the prior art, this invention provides a flexible solution to converting to automation processes with a high level of security. It allows all of the current procedures to continue, while providing a means of automation to be installed as demand requires and as trust allows. The new system is fully compatible with the methods used today, yet offers the powerful opportunities in automation provided by high speed computers and machine processing. The current invention utilizes some features of the art, teaches new features and combines them to result in a useful invention. The result is surprising because the; product of the invention is simpler to use, while speed, accuracy and security are increased. The new application allows widespread use for automatic bank check processing that was heretofore not available.

The invention provides improved ways and means of using data on negotiable instruments such as a money order or a bank check. Currently, the system to record the amount to be paid on a check comprises two data fields. A first data field, for written data in numeric format with one or more digits representing the amount to be paid, and a second field in which the amount to be paid is written in words. These two fields are not used in the invention, but are replaced by new fields and a means of communication between the new fields. The first field is provided for use in a similar way to the old method, the amount to be paid is to be written by the check writer in numerals. The primary difference being that each digit of the numeral is restricted to a designated position that aligns the digits spatially with a translation means. The second data field indicates the amount to be paid in a way that can be optically read by machines and can be easily written without special skills by the writer of the document. This is possible because a translation means is provided to make simple, the conversion of the human usable data of the first field to the machine usable data of the second field. The new data system is easily usable by both machine processors and human users. The combination, and features of the combination of the elements described, were made with consideration of the requirements of use of financial documents and of accounting mechanisms.

The invention yields many valuable advantages over the known art. Processing automation is greatly increased by the invention because complete machine readability of the new document is possible. The document is immune to the possibility of fraud known in the methods and devices of the prior art. Furthermore, the new document is simple to use. Users of financial instruments that have difficulty with the language skills that are required to prepare instruments of the known art can fine relief in the simplicity of the new document. Since the new data system is fully compatible with all current handling processes, the invention can be introduced to industry with minimal problems and minimal changes to reliable practices.

BRIEF DESCRIPTION OF THE DRAWINGS

The drawing of FIG. 1 is an example of an embodiment of the invention.

The drawing of FIG. 2 is a detail of two information fields and the translation means between them.

PREFERRED EMBODIMENTS OF THE INVENTION

Figure 1:
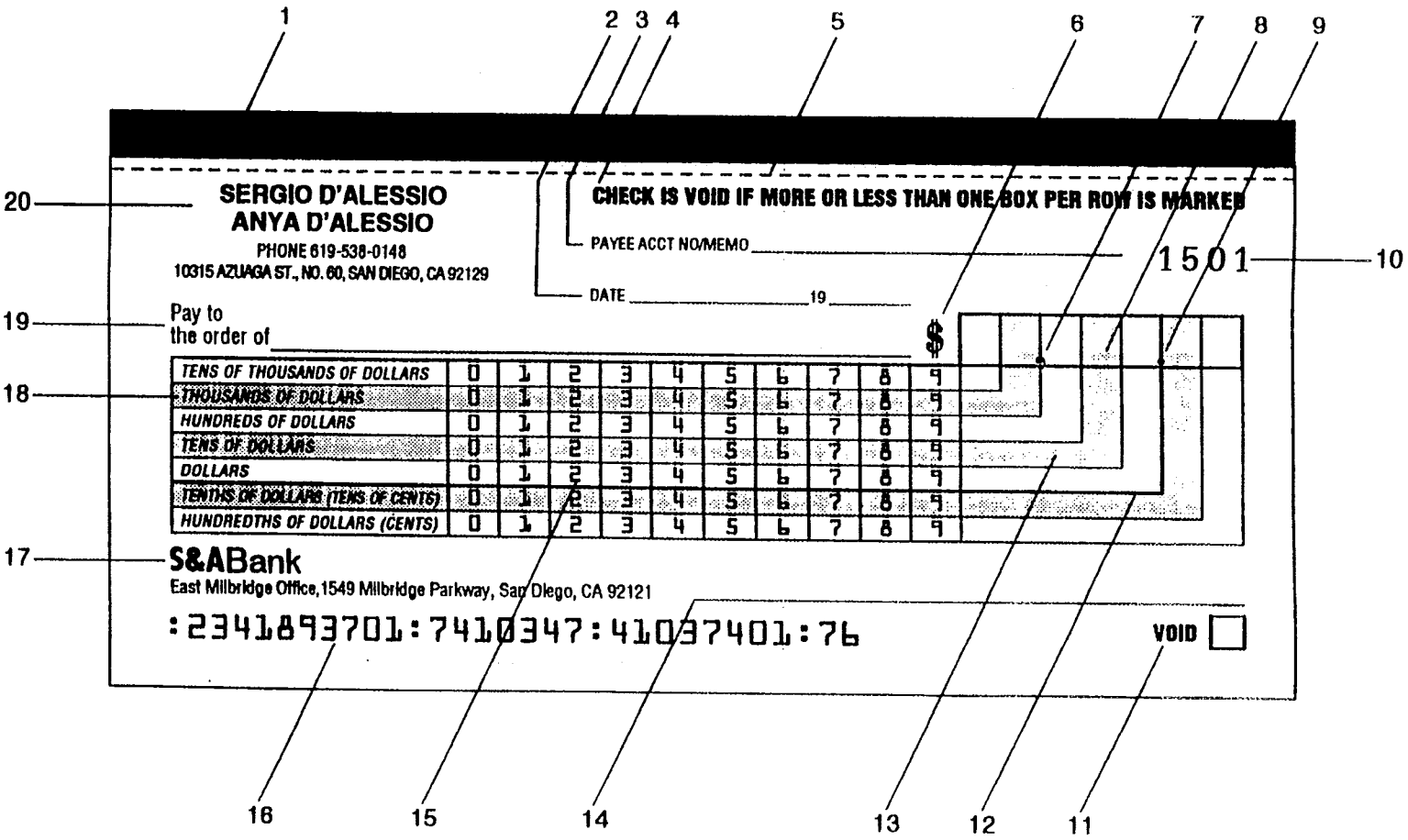
Figure 2:
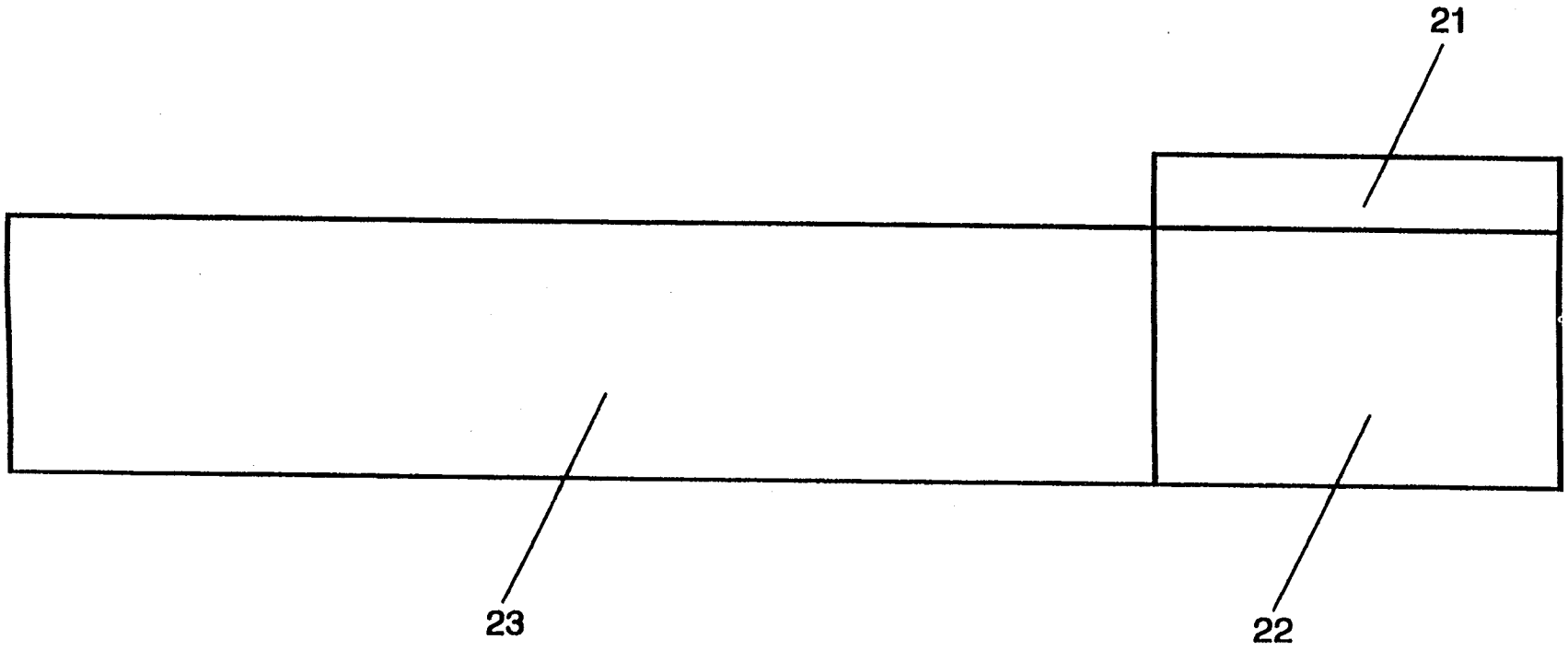
Figure 3:
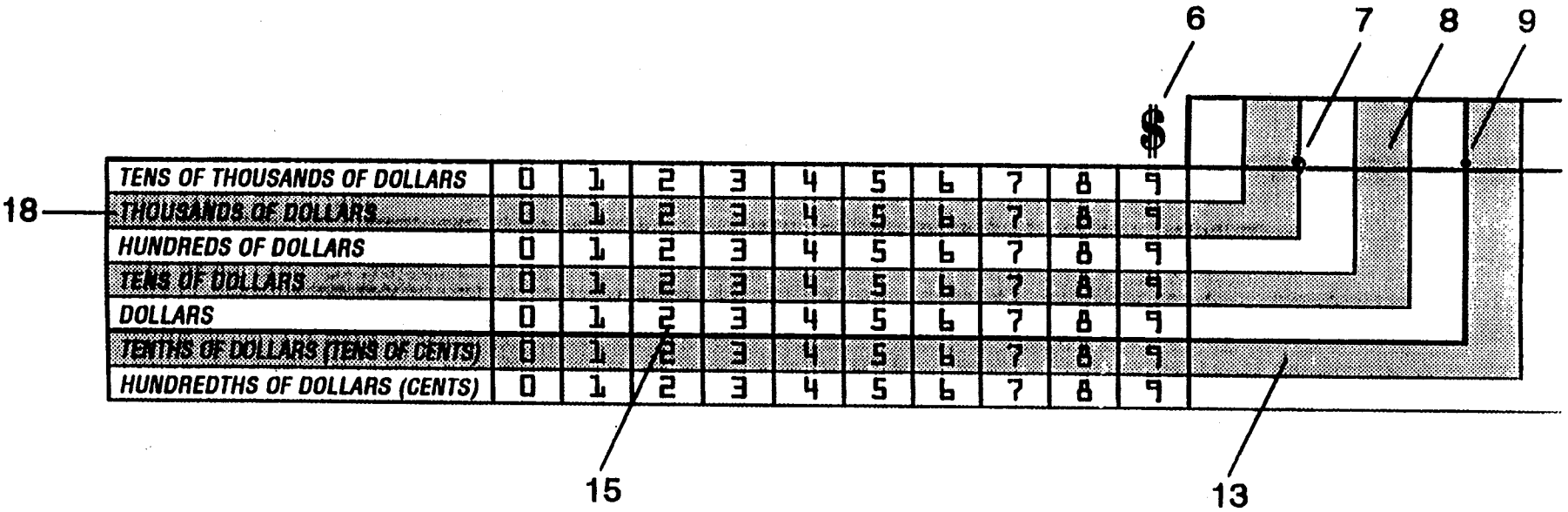
FIG. 3 is a drawing including examples of indicia.

Preferred embodiments of the invention are presented here in detail with reference to the drawings. An embodiment of the invention may include one or more of known information fields (19), (20), on a bank check and they may be arranged in a manner similar to how they would be arranged on known documents. For example, the documents of the invention can be used in a check book format with many blank documents bound at a common binding means (1). Each document could be individually separated therefrom by way of a perforation (5). Indicia including a blank line (3) for entry of a payee account number, note or memo is provided. Indicia (2) for entry of the current date could be included. Indicia to support the amount and denomination or currency, for example a dollar sign (6); a comma (7), to separate the thousands of dollars; and a decimal point (9), to separate the fraction in hundredths of dollars is commonly known in the art and can be incorporated into embodiments of the invention. For some European nations the functions of the comma and of the decimal are reversed; the comma separates the fractional part of the :numeral and the decimal separates the thousands. It is useful to provide documents that are numbered serially with respect to other documents of the same account and a field with such number (10) appears on the face of the documents. A bank (or other issuing institution, for example an insurance company), name and address (17), can appear as shown. Numeric information (16) that is non-variable from check-to-check can be coded into the document with special magnetic ink and a special font for that purpose. A signature line with any supporting indicia may appear in the lower portion of the document (14). If a mistake is made during the writing of a check and the writer wishes to void that document, a box (11) is provided to receive a mark to indicate a void. If the check is used improperly, a void can be invoked and a warning to that effect (4) may be provided. It is intended that other devices and techniques in the art be fully compatible with embodiments of the invention. Even advance techniques that were recently developed and that are the subjects of U.S. Pat. Nos. 4,634,148 and 4,588,211 digitizing variable information for reproduction later; 4,681,348 an anti-tampering means; and an anti-reproduction means of 5,074,596, could be used in embodiments of the current invention.

The instrument of the invention is primarily different than previous documents, and is distinguished therefrom by the introduction of two new fields and a means of translation between those new fields. A first field for data that is in a format that is human usable, is spatially related to a second field for data that is in a format that is machine usable.

In a preferred embodiment of the invention, a negotiable instrument operable for automatic machine processing having data fields for presenting and recording the amount to be paid therein, said negotiable instrument comprising: a) a first data field that is operable for the presentation and recording of numeric data in a format that is usable by a human user; b) a second data field that is operable for the presentation of and recording of numeric data in a format that is easily usable by a machine device; and c) a means of translation of the data in the first data field to the data in the second data field, is provided.

A first data field (21) is an area provided for presentation and recording of numeric data to indicate the amount of the check in a format that is easily read and written by human users. A number with at least one digit that has a decimal point to indicate the place in order of magnitude of each digit of the number uniquely defines the amount in a way that is customary and recognizable in presentations of numbers. A distinct area, a sub-field (8), for each digit is defined and several sub-fields are provided so that a number up to 99,999.99 can be represented. It is possible to leave blank the sub-fields of the highest decimal value. It is also possible to enter zero into the highest decimal value sub-fields and it is possible to leave indicia to cross-out or nullify the highest decimal values when not used. Each sub-field area is intended to contain a single digit and to substantially restrict the position of the digit to the space contained within the area. Entry of numerals into the areas may be made by a machine printing apparatus or by the check writers hand. The numeric data entered into the first data field can be variable in size and form as long as the digits that make; up a numeral are substantially contained or at least substantially centered within the areas provided. Restriction to the areas provided for digits sets-up a mechanism that is used in a translation means.

Figure 4:
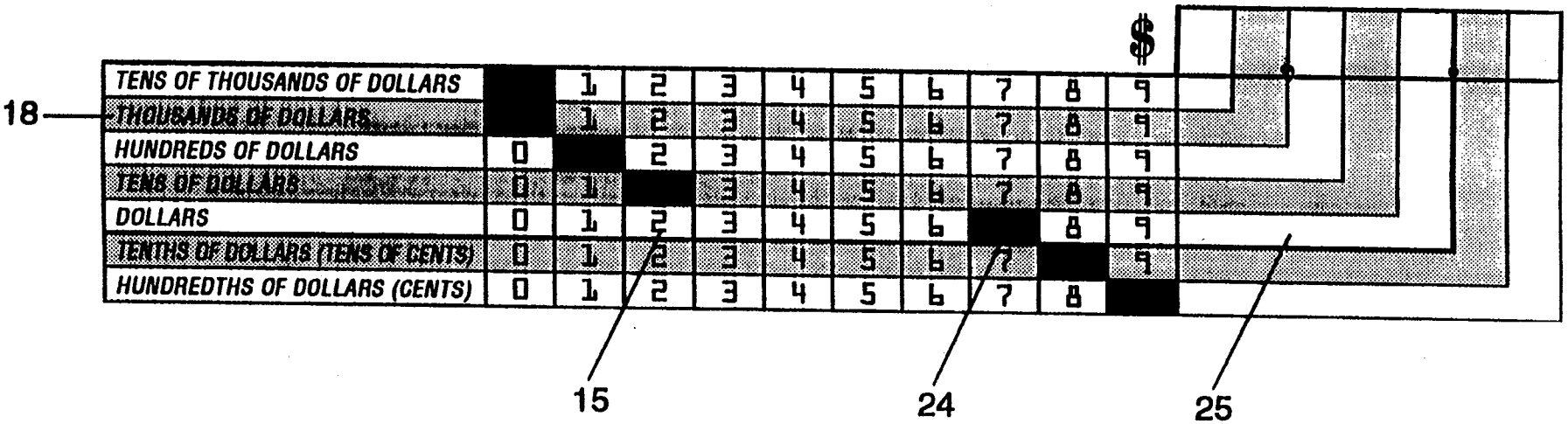
FIG. 4 shows a machine readable field with indicia therein.

A second field (23), and detailed in FIG. 4 is operable for presentation and recording of numeric data in a format that is usable by machine processors. A machine usable format that only requiers inexpensive equipment for reading, is a spatial optical pattern. It is easily created by darkening with ink or a pencil selected sub-fields (24) that are scanned by a machine reader. It is possible to punch holes through the docuument and shine light therethrought, again creating an optical pattern. For the present application, a portion of the second data field can be divided into sub-fields in a two dimensional matrix. Each row of the matrix corresponds to a particular decimal place of the number which represents the amount of the check. Indicia to label each row (18) can be placed in the second data field next to the matrix. In each row are ten sub-fields (15) one each to represent the digits 0–9. After a sub-field is selected that corresponds to the value of the decimal position represented by that row, the sub-field can be marked.

A third field (23) is not a data field, but a translation means. The function of the translation means is to provide a means to convert the numerically represented data of the first data field into an optical pattern, or spatially represented data of the second data field. Indicia, usually lines (22), relate the decimal position of each digit of the numeral to a row of the matrix. It is common in accounting systems where rows are to be followed to separate adjacent rows with shading (13 ) or other differentiation means. It is possible to include this mechanism in the translation means. It is possible that the translation means works by proximity and the third field be omitted. It is also possible that the decimal places are translated into columns instead of rows.

In another preferred embodiment of the invention, a method of preparing a negotiable instrument wherein the amount to be paid is specified in data that is in a human format and in a machine usable format, the steps of generating said human usable and said machine usable data comprise: a) entering the human usable data numerically into a first data field; b) translating time human usable numeric data of the first data field to a machine usable data of a second data field; and c) entering the machine usable data spatially into the second data field, is provided.

Entering data into the first field can be done with a simple writing implement and in hand written numerals. It is preferred that each digit of the numeral be written into a specific sub-field that corresponds to the decimal value of the digit. The digits are than spatially aligned with a translation means.

The data should be translated a single digit at a time. From the position of a first sub-field in the first data field, a path can be followed that leads to a row in the second data field matrix. The path is defined by lines (12) that lead from the first data field to the second data field. From the 10 sub-fields of that row, identified by the digits 0–9, is a single field which corresponds to the value of the digit in the first data field and that subfield of the matrix is selected. Each subsequent digit of the numeral written in the first sub field of the data field is similarly translated to a sub-field of the second data field matrix. After a sub-field is selected in the translation step, it can be marked for a machine reader. Marking a sub-field for optical detection can be affected in many ways including ink marks, pencil markings, punched holes, et cetera. Various techniques for optical detection of spatially recorded data are well known.

In another preferred embodiment of the invention, a method of reading the amount to be paid of a negotiable instrument comprising the step of converting a spatial matrix optical pattern into a decimal representation of said amount, is provided.

The amount of a negotiable instrument having been previously coded into a data field by position specific marks that indicate the decimal values and decimal places of a number which specifies the amount to be paid, can be read by detecting the positions of the marks and relating those positions with a known algorithm to convert those spatial data into binary or decimal data. Systems for accounting transactions can then use the decimal or binary data to complete processing.

Having described examples of preferred embodiments of the invention, it can be appreciated that the objects of the invention have been fully achieved, and it should be understood by those skilled in the art that changes in portions of the embodiments and changes in applications of those embodiments will become apparent without deviating from the full scope and spirit of the: invention envisaged by the inventors and claimed. These examples are illustrations of a best modes but should not be considered the limits of the invention; the limits of the scope of the invention are set forth in the claims appended herewith.

What is claimed is:

1. A negotiable instrument operable for automatic machine processing having data fields for presenting and recording the amount to be paid therein, said negotiable instrument comprising:

a) a first data field that is operable for the presentation and recording of numeric data in a format that is usable by a human user;

b) a second data field that is ,operable for the presentation of and recording of numeric data in a format that is easily usable by a machine device; and c) a means of translation of the data in the first data field to the data in the second data field, said means being indicia defining a path from said first data field to said second data field.

2. A negotiable instrument of claim 1 wherein:

a) said first data field comprises a plurality of sub-fields that correspond to the decimal places of a number and said numeric data of the first data field being comprised of at least one digit, each digit being substantially restricted to and substantially centered in a sub-field of the first data field;

b) said second data field comprising a plurality of sub-fields in a matrix, each sub-field having indicia therein, said numeric data of the second data field comprises of at least one digit, each digit being uniquely defined spatially within said material;

c) said means of translation of the data in the first data field to the data in the second data field comprising of a spatial relationship between each digit of the first data field and a row of the second data field matrix and indicia to emphasize the spatial relationship.

3. A negotiable instrument of claim 1 wherein:

a) said first data field comprises a plurality of sub-fields that correspond to the decimal places of a number and said numeric data of the first data field being comprised of at least one digit, each digit being substantially restricted to and substantially centered in a sub-field of the first data field;

b) said second data field comprising a plurality of sub-fields in a matrix, each sub-field having indicia therein, said numeric data of the second data field comprises of at least one digit, each digit being uniquely defined spatially within said material;

c) said means of translation of the data in the first data field to the data in the second data field comprising of a spatial relationship between each digit of the first data field and a column of the second data field matrix and indicia to emphasize the spatial relationship.

4. A method of preparing a negotiable instrument wherein the amount to be paid is specified in data that is in a human format and in a machine usable format, the steps of generating said human usable and said machine usable data comprise:

a) entering the human usable data numerically into a first data field;

b) translating the human usable numeric data of the first data field to a machine usable data of a second data field; and c) entering the machine usable data spatially into the second data field.

5. The method of claim 4 wherein:

a) entering the data numerically into a first data field comprises further of hand writing digits substantially into a plurality of sub-fields within the first data field wherein the hand written digits are easily usable by human users and indicate the amount to be paid on the negotiable instrument;

b) translating the human usable numeric data of the first data field to spatially specific machine usable data of a second data field comprising further of choosing from the decimal location of the human usable numeric data the corresponding row of the matrix, said corresponding row containing indicia of digits from "0" sequentially to "9" in sub-fields of said corresponding row; and choosing the sub-field within said corresponding row which corresponds to the value of the digit of the sub-field of the first data field;

c) entering the machine usable data into the second data field comprises further of hand marking sub-field areas of the second data field matrix that corresponds to the digits of the human usable data of the first data field, said marking being sufficient for a machine detector to detect said mark.

6. The method of claim 4 wherein:

a) entering the data numerically into a first data field comprises further of hand writing digits substantially into a plurality of sub-fields within the first data field wherein the hand written digits are easily usable by human users and indicate the amount to be paid on the negotiable instrument;

b) translating the human usable numeric data of the first data field to spatially specific machine usable data of a second data field comprising further of choosing from the decimal location of the human usable numeric data the corresponding column of the matrix, said corresponding row containing indicia of digits from "0" sequentially to "9" in sub-fields of said corresponding column; and choosing the sub-field within said corresponding row which corresponds to the value of the digit of the sub-field of the first data field;

c) entering the machine usable data into the second data field comprises further of hand marking sub-field areas of the second data field matrix that corresponds to the digits of the human usable data of the first data field, said marking being sufficient for a machine detector to detect said mark.

* * * * *